US010544534B2

(12) United States Patent
Tian et al.

(10) Patent No.: US 10,544,534 B2
(45) Date of Patent: Jan. 28, 2020

(54) BOTTOM FOOT OF WASHING MACHINE WITH AUTOMATIC WEIGHING STRUCTURE

(71) Applicant: QINGDAO HAIER WASHING MACHINE CO., LTD., Shandong (CN)

(72) Inventors: Yun Tian, Shandong (CN); Gangjin Zhang, Shandong (CN); Chunxia Zhou, Shandong (CN); Feng Li, Shandong (CN)

(73) Assignee: QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 211 days.

(21) Appl. No.: 15/557,272

(22) PCT Filed: Nov. 23, 2015

(86) PCT No.: PCT/CN2015/095298
§ 371 (c)(1),
(2) Date: Sep. 11, 2017

(87) PCT Pub. No.: WO2016/141734
PCT Pub. Date: Sep. 15, 2016

(65) Prior Publication Data

US 2018/0057993 A1 Mar. 1, 2018

(30) Foreign Application Priority Data

Mar. 12, 2015 (CN) ..... 2015 1 0108416

(51) Int. Cl.
*D06F 39/00* (2006.01)
*D06F 37/20* (2006.01)

(52) U.S. Cl.
CPC ..... *D06F 39/003* (2013.01); *D06F 37/20* (2013.01); *D06F 2202/10* (2013.01)

(58) Field of Classification Search
CPC ..... D06F 39/003; D06F 39/125; D06F 37/20; D06F 2202/10
(Continued)

(56) References Cited

FOREIGN PATENT DOCUMENTS

CN 2534215 Y 2/2003
CN 101736565 A 6/2010
(Continued)

OTHER PUBLICATIONS

CN2534215Y—Machine translation (Year: 2003).*
(Continued)

*Primary Examiner* — Michael E Barr
*Assistant Examiner* — Tinsae B Ayalew
(74) *Attorney, Agent, or Firm* — Buchanan Ingersoll & Rooney PC

(57) ABSTRACT

A washer bottom foot is installed below a base of a washing machine and has a weighing sensor. A cavity with a downward opening is provided in the bottom foot, and the weighing sensor is installed in the cavity in a closed manner. The bottom foot comprises a connecting portion and a supporting portion, which form an integrated convex structure, wherein the connecting portion is hollow axially, the supporting portion is provided below the connecting portion, and the cavity is provided in the supporting portion and communicates with a hollow portion of the connecting portion. The supporting piece comprises a supporting unit and a fixing unit, an upper end face of the supporting unit being in contact with the weighing sensor, and a lower end face being supported on the ground.

10 Claims, 3 Drawing Sheets

(58) Field of Classification Search
USPC ..... 68/12.04
See application file for complete search history.

(56) References Cited

FOREIGN PATENT DOCUMENTS

| | | | |
|---|---|---|---|
| CN | 101824734 | A | 9/2010 |
| CN | 102691194 | A | 9/2012 |
| CN | 203383025 | U | 1/2014 |
| JP | 04-319392 | A | 11/1992 |
| JP | 07-136379 | A | 5/1995 |
| WO | WO-2012089442 | A1 * | 7/2012 |

OTHER PUBLICATIONS

International Search Report (PCT/ISA/210) dated Feb. 29, 2016, by the Chinese Patent Office as the International Searching Authority for International Application No. PCT/CN2015/095298.
Written Opinion (PCT/ISA/237) dated Feb. 29, 2016, by the Chinese Patent Office as the International Searching Authority for International Application No. PCT/CN2015/095298.

* cited by examiner

BOTTOM FOOT OF WASHING MACHINE WITH AUTOMATIC WEIGHING STRUCTURE

TECHNICAL FIELD

The present disclosure relates to a technical field of washing machines, specifically to a supporting structure of a washing machine, in particular to a bottom foot of a washing machine with automatic weighing structure.

BACKGROUND

The existing washing machines are driven by the motor to bring the washing tub contained laundry to rotate and work properly, and the existing washing machines all have weighing function. There are many ways to realize the weighing function of the washing machine, one way is that the first torque of the motor is measured by controlling the motor to reach the first predetermined rotational speed and rotates the motor at a uniform speed at the first predetermined speed, and then controls the motor to accelerate the motor from the first predetermined rotational speed to the second predetermined rotational speed and measures the rising torque when the motor is raised from the first predetermined rotational speed to the second predetermined rotational speed, and finally controls the motor to rotate at the second predetermined speed uniformly, measures the second torque of the motor at this time and calculate the weight of the laundry in the washing tub according to the change of the torque. One way is that the motor is controlled to reach the first predetermined speed, and then cuts off the power of the motor, detects the number of turns of motor from the power off to still to calculate the weight of the laundry inside the washing tub. Another way is that the motor is controlled to reach the first predetermined speed, and then cuts off the power of the motor and detects the back electromotive force generated after the motor being cut off to calculate the weight of the laundry inside the washing tub.

No matter what kind of way to achieve measurement of the weight of the laundry, they are through motor to measure the weight of the laundry. These measurements are often affected by the type of motor, the tension of the drive belt, the friction of the washing tub system and other conditions, the measurement accuracy is not high, and a lot of situations of wrong judgments. Often a small amount of clothing in the washing machine is measured as a lot of clothing, resulting in a waste of laundry water, and in many times a lot of clothing in the washing tub is measured as a small amount of clothing, resulting in inadequate washing water and clothing are not fully cleaned. This weighing method can only be used as a general reference, besides it also cannot be used as a judge of how much water to be used. Now people are advocating environmental protection, not only to save water, but also less use of detergents, and a best match among clothing, detergent, and washing water is expected, the weighing methods mentioned above are difficult to meet user requirements.

The Chinese patent application No. 201320340304.3 discloses a washing machine with a suspension system which relates to a field of washing machine. The washing machine comprises a housing and a washing tub, wherein, the washing machine comprises a suspension system. The suspension system comprises a suspension foot, a boom, a spring sleeve, a spring, a spring seat, a load cell, and a sensor seat. The suspension system is fixedly connected to the housing through the suspension foot and fixedly connected to the washing tub through the spring sleeve. The boom is arranged on the suspension foot, and the spring sleeve, the spring, the spring seat, the lock cell and the sensor seat are all sleeving on the boom. The spring is mounted between the spring sleeve and the spring seat in a suspended pattern, the load cell is mounted between the spring seat and the sensor seat, the sensor seat is fixedly relative to the boom.

Although the above structure accurately measures the weight of the laundry, there are still the following defects: as the load cell installed in the suspension system, the washing machine components are more complex to install, difficult to track, and security risks are existed. In addition, as the suspension system is mainly used for shock absorption, the washing tub assembly has a bigger vibration during the work process, which results in a larger pressure change of the load cell installed between the spring seat and the sensor seat, and it shortens the service life.

The Chinese patent application No. 201210176786.3 discloses a laundry machine weight sensing device and a method of using the same, which comprises a weighing device installed on the washing machine and a weighing circuit connected to the weighing device. The weighing circuit comprises a microprocessor, a varistor and a voltage dividing protection resistor connected in series with each other and connected to the microprocessor, and is calculated by the change in the resistance value of the varistor. The weighing device is located on upper side of the cover of the housing to facilitate the placement of clothing. The weighing device may be a weighing device such as an electronic balance.

The structure is equivalent to embed the existing electronic balance in the top cover of the housing of the washing machine. Although it is able to measure the weight of clothing, the clothing need to be weighed on the weighing device before each washing and then to be threw into the washing machine to wash, and the user is very troublesome to use. Besides, the device cannot measure the amount of water using in the washing machine.

In the view of foregoing, the present disclosure is proposed.

SUMMARY

The technical problem needs to solved of the present disclosure is to overcome the shortcomings of the prior art and to provide bottom foot of a washing machine with automatic weighing structure which has a simple structure and is easy to install, and the weighing measurement is accurate and it has a long service life.

In order to solve the technical problem mentioned above, the basic ides of the technical scheme adopted by the present disclosure is:

A bottom foot of a washing machine with automatic weighing structure comprising a bottom foot installed below a base of the washing machine and a weighing sensor installed on the bottom foot. A cavity with a downward opening is provided at a bottom of the bottom foot, the weighing sensor is installed in the cavity via a supporting piece in a closed manner.

Further, the bottom foot is hollow axially, a lead wire of the weighing sensor is electrically connected to a body of the washing machine through a hollow portion which is hollow axially.

Further, the bottom foot comprises a connecting portion and a supporting portion, which the form an integrated convex structure. The connecting portion is hollow axially, and threads are provided on an outer wall of the connecting portion. The supporting portion is provided below the connecting portion, and the cavity is provided in the supporting portion which is communicated with the hollow portion of the connecting portion.

Further, the bottom foot is a regulating bolt comprising a screw and a bolt head. The bolt head is provided with the cavity, the weighing sensor is installed in the cavity. The hollow portion for routing line of the weighing sensor is axially provided in the screw and the hollow portion is communicated with the cavity.

Further, the weighing sensor is fixedly installed relative to the bottom foot in the cavity. Preferably, the weighing sensor is fixed in the cavity through a bolt or other fixing methods such as plastic hot melt welding.

Further, the supporting piece comprises a supporting unit and a fixing unit, through the fixing unit the supporting unit is installed in the cavity movably. An upper end surface of the supporting unit is in contact with the weighing sensor, and a lower end surface is supported on the ground.

Further, the supporting unit comprises a supporting body and an annular convex rib provided on a periphery of the supporting body. The supporting unit is an annular fixing seat, and a lower end of the supporting body is passed through the hollow portion of the fixing seat. The fixing seat supports below the annular convex rib and is fixedly connected with the bottom foot.

Further, the supporting body comprises a rubber foot and a supporting sheet provided on the rubber foot. The rubber foot is a cylindrical structure, the supporting sheet is a disc structure which is inverted on an upper end of the rubber foot, and an outer circumference of the rubber foot is provided with the annular convex rib.

Further, an inner side of the fixing seat is provided with a boss, the annular convex rib is supported by the boss.

Further, the supporting unit is fixed relative to the bottom foot in a circumferential direction.

Further, an inner wall of the cavity is provided with a reinforcing rib in an axial direction.

The present disclosure has the following beneficial effects comparing to the prior art by adopting the technical scheme mentioned above.

The present disclosure provides a structure which is able to automatically weigh the clothing and the water in the washing tub of the washing machine. The structure has a high precision weighing and a minor error, which is able to precisely determine the weight of clothing before washing, the amount of water intake, the amount of water discharge, the water contained in the clothing and so on. Thus, the automation and intelligent function of the washing machine is improved.

The structure of the present disclosure is applied in the washing machine which is able to measure the weight of the clothing precisely. And an appropriate washing procedure is used so that appropriate amount of water is added to wash. Thus it achieves a low energy and a low water consumption, it is environmental protection and saves the cost, the clothing is cleaned at the same time.

DETAILED DESCRIPTION

Figure 1:
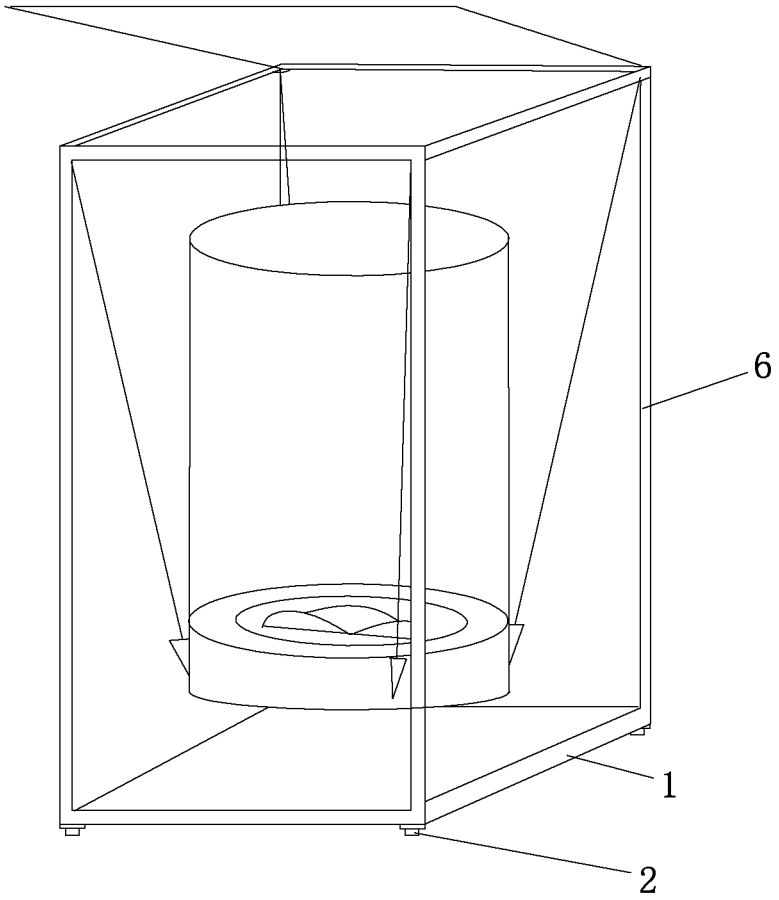
FIG. 1 is a schematic diagram of a washing machine of the present disclosure.

The present disclosure will be described below in detail with reference to accompanying drawings and embodiments.

As shown in from FIG. 1 to FIG. 4, the bottom foot of the washing machine with automatic weighing structure of the present disclosure is mounted below the base 1 of the washing machine, which comprises the bottom foot 2 and the weighing sensor 3 installed on the bottom foot. A cavity 4 with a downward opening is provided at a bottom of the bottom foot 2, the weighing sensor 3 is installed in the cavity 4 via a supporting piece 5 in a closed manner. The bottom foot 2 is hollow axially (see FIG. 3), a lead wire 31 of the weighing sensor 3 is electrically connected to a body of the washing machine 6 through a hollow portion 20 which is hollow axially.

Figure 2:
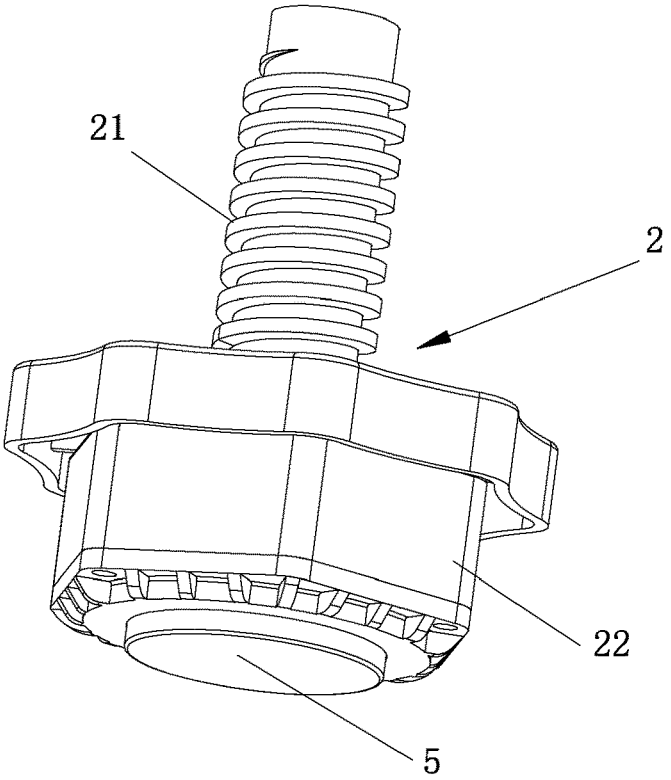
FIG. 2 is a schematic diagram of a bottom foot of the washing machine with automatic weighing structure of the present disclosure.
Figure 3:
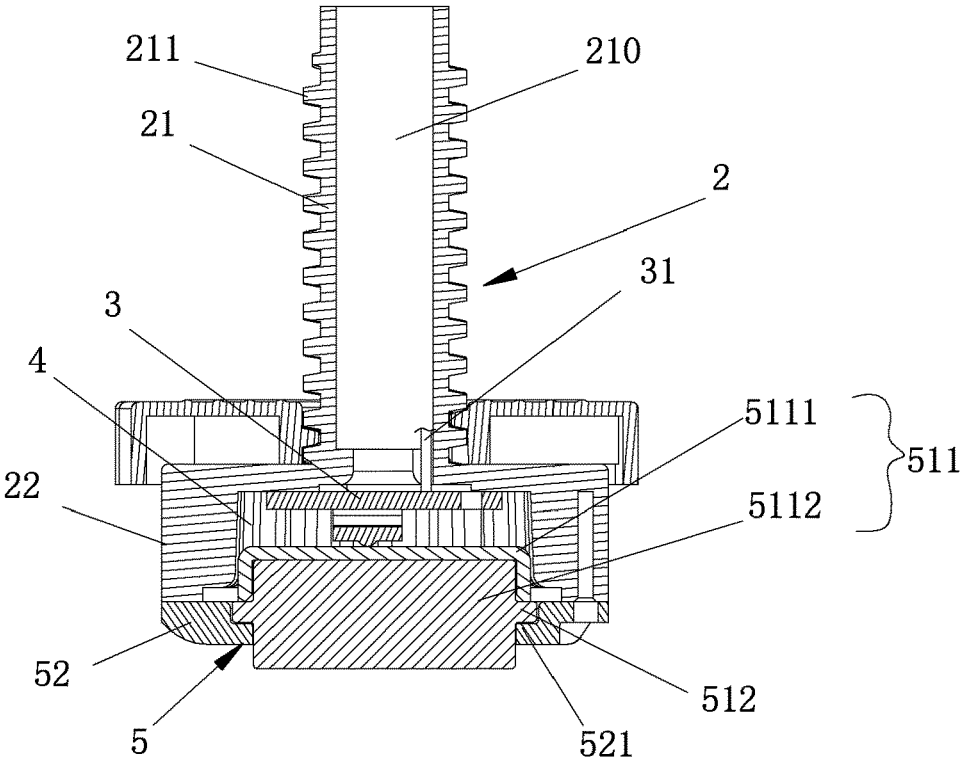
FIG. 3 is a cross-sectional view of the bottom foot of the washing machine with automatic weighing structure of the present disclosure.

As shown in FIG. 2 and FIG. 3, in the present disclosure, the bottom foot 2 comprises a connecting portion 21 and a supporting portion 22, which the form an integrated convex structure. The connecting portion 21 is hollow axially, and threads 211 are provided on an outer wall of the connecting portion. The supporting portion 22 is provided below the connecting portion 21, and is supported on the ground. The cavity 4 is provided in the supporting portion 22 which is communicated with the hollow portion 210 of the connecting portion 21. The opening of the cavity is facing downward to the ground and is supported on the ground via the supporting piece 5.

In the present disclosure, the bottom foot 2 is a regulating bolt comprising a screw and a bolt head. The screw acts as the connecting portion 21 which is connected with the base 1 of the washing machine, the bolt head acts as the supporting portion 22, the screw is hollow axially for routing line of the weighing sensor 3.

In order to prevent the relative movement between the weighing sensor and the bottom foot during the rotation of the bottom foot and resulting in inaccurate weighing measurement, the weighing sensor 3 and the bottom foot 2 are fixedly mounted in the cavity 4 of the present disclosure relative to each other. Preferably, the weighing sensor 3 is fixed in the cavity 4 through a bolt or other fixing methods such as plastic hot melt welding.

In the present disclosure, the supporting piece 5 comprises a supporting unit 51 and a fixing unit 52. Through the fixing unit 52 the supporting unit 51 is installed in the opening of the cavity 4 movably. An upper end surface of the supporting unit 51 is in contact with the weighing sensor 3, and a lower end surface is supported on the ground. When the weight of the washing machine assembly changes, the gravitational force held by the supporting unit is transmitted to the weighing sensor by axial deformation.

Figure 4:
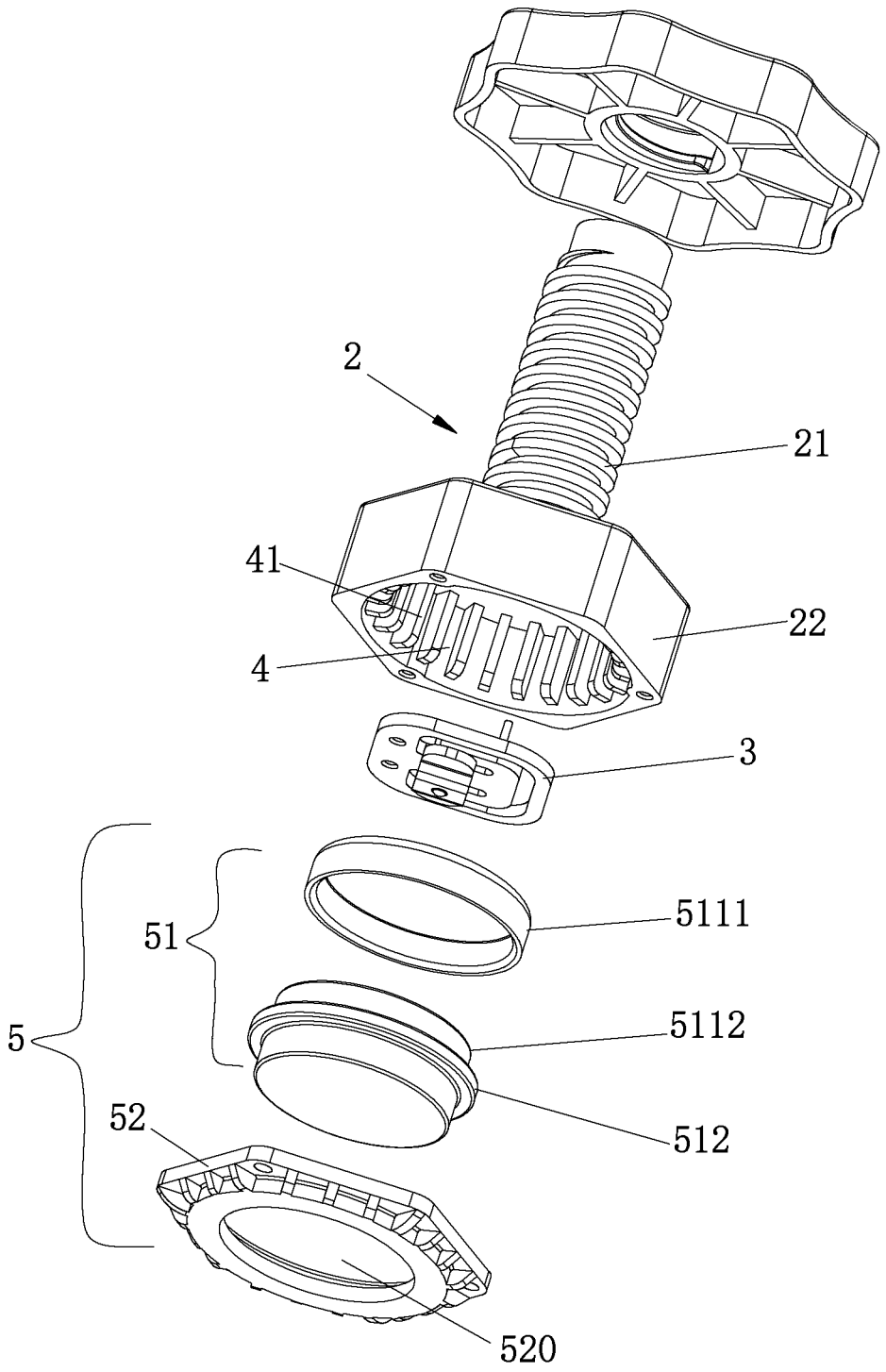
FIG. 4 is a schematic view of the assembly of the bottom foot of the washing machine with automatic weighing structure of the present disclosure.

Specifically, as shown in FIG. 3 and FIG. 4, the supporting unit 51 comprises a supporting body 511 and an annular convex rib 512 provided on a periphery of the supporting body 511. The supporting unit 52 is an annular fixing seat. A lower end of the supporting body 511 is passed through the hollow portion 520 of the fixing seat, the fixing seat 52 supports below the annular convex rib 512 and is fixedly connected with the bottom foot 2. The structure makes the fixing seat able to limit the supporting body in the cavity and not to limit the axial deformation. The fixing seat is fixedly connected with the supporting portion 22 via a bolt. Preferably, an inner side of the fixing seat 52 is provided with a boss 521, the annular convex rib 512 is supported by the boss 521. The structure makes the assembly of the fixing seat 52 and the supporting unit 51 more compact.

Further, the supporting body 511 comprises a rubber foot 5112 and a supporting sheet 5111 provided on the rubber foot 5112. The rubber foot 5112 is a cylindrical structure, the supporting sheet 5111 is a disc structure which is inverted on an upper end of the rubber foot 5112, and an outer circumference of the rubber foot 5112 is provided with the annular convex rib 512. The rubber feet 512 have a certain buffer effect, and the supporting piece is made of material which has sufficient strength and smaller deformation. In order to prevent the support piece from sliding on the plane vertical to the axial direction to affect the measurement accuracy of the weighing sensor, the supporting sheet 5111 is fixed relative to the bottom foot 2 on the plane vertical to the axial direction. The rubber foot 5112 and the supporting sheet 5111 could be relatively rotatable or could be relatively fixed.

Or, the support piece 5111 and the rubber foot 5112 may be designed as a unitary structure.

Further, an inner wall of the cavity 4 is provided with a reinforcing rib 41 in an axial direction to enhance the support strength of the supporting portion. Preferably, the reinforcing ribs are for multiple groups, a limiting slide way is constituted between the two adjacent reinforcing ribs. The supporting unit is provided with a limiting slider (not shown in Figs.) on the outer wall, the limiting slider is slidably mounted in the slide way so that the supporting unit is able to move up and down in the cavity and is fixed relative to the bottom foot on the plane vertical to the axial direction to rotate together.

The above-described embodiments are merely illustrative of the preferred embodiments of the present disclosure and are not intended to limit the scope and scope of the disclosure. It will be understood by those skilled in the art that various changes and modifications in the technical solutions of the present disclosure are within the scope of the present disclosure without departing from the design idea of the present disclosure.

The invention claimed is:

1. A bottom foot of a washing machine with automatic weighing structure, comprising a bottom foot installed below a base of the washing machine and a weighing sensor installed on the bottom foot, wherein, a cavity with a downward opening is provided at a bottom of the bottom foot, the weighing sensor is installed in the cavity via a supporting piece in a closed manner;

the bottom foot comprises a connecting portion and a supporting portion, which form an integrated convex structure, the connecting portion is hollow axially, threads are provided on an outer wall of the connecting portion, the supporting portion is provided below the connecting portion, and the cavity is provided in the supporting portion which communicates with the hollow portion of the connecting portion.

2. The bottom foot of the washing machine with automatic weighing structure according to claim 1, wherein, a lead wire of the weighing sensor is electrically connected to a body of the washing machine through a hollow portion which is hollow axially.

3. The bottom foot of the washing machine with automatic weighing structure according to claim 1, wherein, the weighing sensor is fixedly installed relative to the bottom foot in the cavity.

4. The bottom foot of the washing machine with automatic weighing structure according to claim 1, wherein, the supporting piece comprises a supporting unit and a fixing unit, through the fixing unit, the supporting unit is installed in the cavity movably, an upper end surface of the supporting unit is in contact with the weighing sensor, and a lower end surface is supported on a ground.

5. The bottom foot of the washing machine with automatic weighing structure according to claim 4, wherein, the supporting unit comprises a supporting body and an annular convex rib provided on a periphery of the supporting body, the supporting unit is an annular fixing seat, a lower end of the supporting body is passed through the hollow portion of the fixing seat, the fixing seat supports below the annular convex rib and is fixedly connected with the bottom foot.

6. The bottom foot of the washing machine with automatic weighing structure according to claim 5, wherein, the supporting body comprises a supporting sheet provided below the weighing sensor and a rubber foot provided below the supporting sheet, the rubber foot is a cylindrical structure, the supporting sheet is a disc structure which is inverted on an upper end of the rubber foot, and an outer circumference of the rubber foot is provided with the annular convex rib.

7. The bottom foot of the washing machine with automatic weighing structure according to claim 5, wherein, an inner side of the fixing seat is provided with a boss, the annular convex rib is supported by the boss.

8. The bottom foot of the washing machine with automatic weighing structure according to claim 4, wherein, the supporting unit is fixed relative to the bottom foot in a circumferential direction.

9. The bottom foot of the washing machine with automatic weighing structure according to claim 1, wherein, an inner wall of the cavity is provided with a reinforcing rib in an axial direction.

10. The bottom foot of the washing machine with automatic weighing structure according to claim 6, wherein, an inner side of the fixing seat is provided with a boss, the annular convex rib is supported by the boss.

* * * * *